US006750191B2

(12) United States Patent
Kasturi et al.

(10) Patent No.: US 6,750,191 B2
(45) Date of Patent: Jun. 15, 2004

(54) METHOD OF SEQUENTIALLY DISPENSING A CONSUMABLE LAYERED LIQUID COMPOSITION AND PRODUCT CONTAINING THE SAME

(75) Inventors: Chandrika Kasturi, Cincinnati, OH (US); Lieven Richard Deketele, Zulte (BE); Tim Maria Joris Van Hauwermeieren, Buggenhout (BE); Ann Germaine Julia Vandevenne, Putte (BE); Sonia Gaaloul, Strombeek-Bever (BE); Joost Ignace De Waele, Oostrozebeke (BE); Dean Larry DuVal, Lebanon, OH (US)

(73) Assignee: Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/441,339

(22) Filed: May 20, 2003

(65) Prior Publication Data

US 2004/0053798 A1 Mar. 18, 2004

Related U.S. Application Data

(60) Provisional application No. 60/385,295, filed on May 31, 2002.

(51) Int. Cl.[7] ..... C11D 9/36; C11D 3/44

(52) U.S. Cl. ..... 510/417; 510/432; 510/466

(58) Field of Search ..... 510/417, 432, 510/466

(56) References Cited

U.S. PATENT DOCUMENTS

| | | | | | |
|---|---|---|---|---|---|
| 3,718,609 | A | * | 2/1973 | Weimer | 510/417 |
| 3,810,478 | A | * | 5/1974 | Olson et al. | 132/209 |
| 4,348,292 | A | * | 9/1982 | Ginn | 510/406 |
| 5,756,106 | A | * | 5/1998 | Concannon et al. | 424/401 |
| 6,019,991 | A | * | 2/2000 | Tanaka et al. | 424/401 |
| 6,521,584 | B1 | * | 2/2003 | Soldanski et al. | 510/417 |

FOREIGN PATENT DOCUMENTS

| | | | |
|---|---|---|---|
| EP | 116422 | * | 8/1984 |
| EP | 175485 | * | 3/1986 |
| GB | 1247189 | * | 9/1971 |

* cited by examiner

*Primary Examiner*—Charles Boyer
(74) *Attorney, Agent, or Firm*—Caroline Wei-Berk; C. Brant Cook; Kim W. Zerby

(57) ABSTRACT

A method of sequentially dispensing a consumable layered liquid composition to treat a fabric article is provided. Suitable consumable layered liquid compositions generally comprise two or more liquid layers, which exhibit a density differential between them and provide sequential refreshing and/or finishing benefits to the fabric article being treated. A fabric care product comprising such composition packaged in a container is also provided.

20 Claims, 1 Drawing Sheet

METHOD OF SEQUENTIALLY DISPENSING A CONSUMABLE LAYERED LIQUID COMPOSITION AND PRODUCT CONTAINING THE SAME

CROSS REFERENCE TO RELATED APPLICATIONS

This application claims priority under Title 35, United States Code 35 U.S.C. 119(e) from Provisional Application Serial No. 60/385,295, filed on May 31, 2002.

FIELD OF THE INVENTION

The present invention relates to a method of sequentially dispensing a consumable layered liquid composition to deliver multiple fabric care benefits. Specifically, the consumable layered liquid composition comprises two or more liquid layers that exhibit a density differential between one another, such that the liquid layers of the composition can be dispensed sequentially. The two or more liquid layers may comprise different actives and/or additives capable of delivering various fabric care benefits to the fabric article being treated. A product containing this consumable layered liquid composition for sequentially delivery of multiple fabric care benefits is also disclosed.

BACKGROUND OF THE INVENTION

Typically, phase separation and/or layer formation in liquid compositions are considered to be negative effects by formulators because the actives in a compositions are designed to collectively achieve certain benefits. Phase separation and/or layer formation tend to prevent accurate dispensing of a representative composition, thus, the dispensed composition may not fully or adequately deliver the desired benefits. To overcome these negative effects, formulators may instruct users of the liquid compositions to shake them before using. By shaking the liquid composition, the actives therein are mixed and the composition becomes a substantially homogeneous dispersion. Thus, upon dispensing, the actives in the composition are delivered together and every dose dispensed is representative of the overall composition. Alternatively, formulators may be required to use expensive ingredients or technologies to maintain the compositions in a stable, homogeneously mixed condition.

Some multi-phase compositions are known in hair care and skin care products, for example, U.S. Pat. Nos. 3,718,609; 4,438,095; and 5,468,496. Multi-phase compositions for hard surface and glass cleaning are also known, for example, Japanese Patent Applications JP 60243199A2; JP 61296099A2 and JP 62263297A2; and PCT publications WO 99/47634 and WO 00/24852A2; and German Patent Application DE 2220540A1. However, these compositions are formulated to deliver the intended benefits together in one dispensing step.

It is sometimes desirable to deliver multiple benefits at different times such that a first active is dispensed in the absence of the second active to deliver the first benefit, and the second active is subsequently dispensed in the absence of the first active to deliver the second benefit. This is especially desirable when the first and second benefits are conflicting benefits. For example, it is not desirable to put a finishing agent on a fabric article prior to subjecting the fabric article to a cleaning agent, which can strip the finishing agent from the fabric article, thus, removing the benefit provided by the finishing agent. Accordingly, in this example, it is desirable to subject the fabric article to the cleaning agent prior to subjecting the fabric article to a finishing agent so that the finishing agent will be present on the fabric article upon completion of the fabric article treating process.

The delivery of multiple benefits at different times has typically been done with multiple formulations, individually packaged and dispensed at different times and/or in different quantities. For example, formulations for washing, rinsing or conditioning for hair, dishes or clothing are packaged and used separately. Inaccurate timing and/or dosing tend to reduce the overall benefits sought by the users. This approach is inconvenient because it relies on the user to administer the timing and/or dosage. This approach is also wasteful because it uses multiple or complex packages which are either destined for trash or consume energy and/or other natural resources to recycle.

Therefore, it is desirable to have a product and a method for using the same for sequentially delivering fabric care benefits to a fabric article via a single consumable composition, preferably in a single container. Such composition is specially formulated to deliver different fabric care benefits at different times. Moreover, it is desirable to have such a consumable composition in a single container to facilitate accurate dosing and timing of the desired benefits. Thus, a fabric care product having such composition packaged in a container is very desirable from the standpoint of convenience, ease-of-use and exact delivery of benefits.

SUMMARY OF THE INVENTION

In one aspect of the present invention, a method for sequentially delivering fabric care benefits to a fabric article is provided via a layered liquid composition. The method comprises the steps of:

a. providing a consumable layered liquid composition, wherein the composition comprises a first liquid layer and a second liquid layer, the first liquid layer and the second liquid layer are discrete layers in direct contact with each other, and optionally, at least one additive in the first or the second liquid layer;

b. dispensing the first liquid layer and contacting the fabric article with the dispensed first liquid layer, thereby delivering a first benefit to the fabric article; and c. dispensing the second liquid layer and contacting the fabric article with the dispensed second liquid layer, thereby delivering a second benefit to the fabric article.

In another aspect of the present invention, a fabric care product comprising at least a unit dose of a consumable layered liquid composition, which comprises a first liquid layer capable of delivering a first benefit, and second liquid layer capable of delivering a second benefit; the first liquid layer and the second liquid layer are discrete layers in direct contact with each other, and a container for the composition, is provided.

DETAILED DESCRIPTION

Definitions

Figure 1:
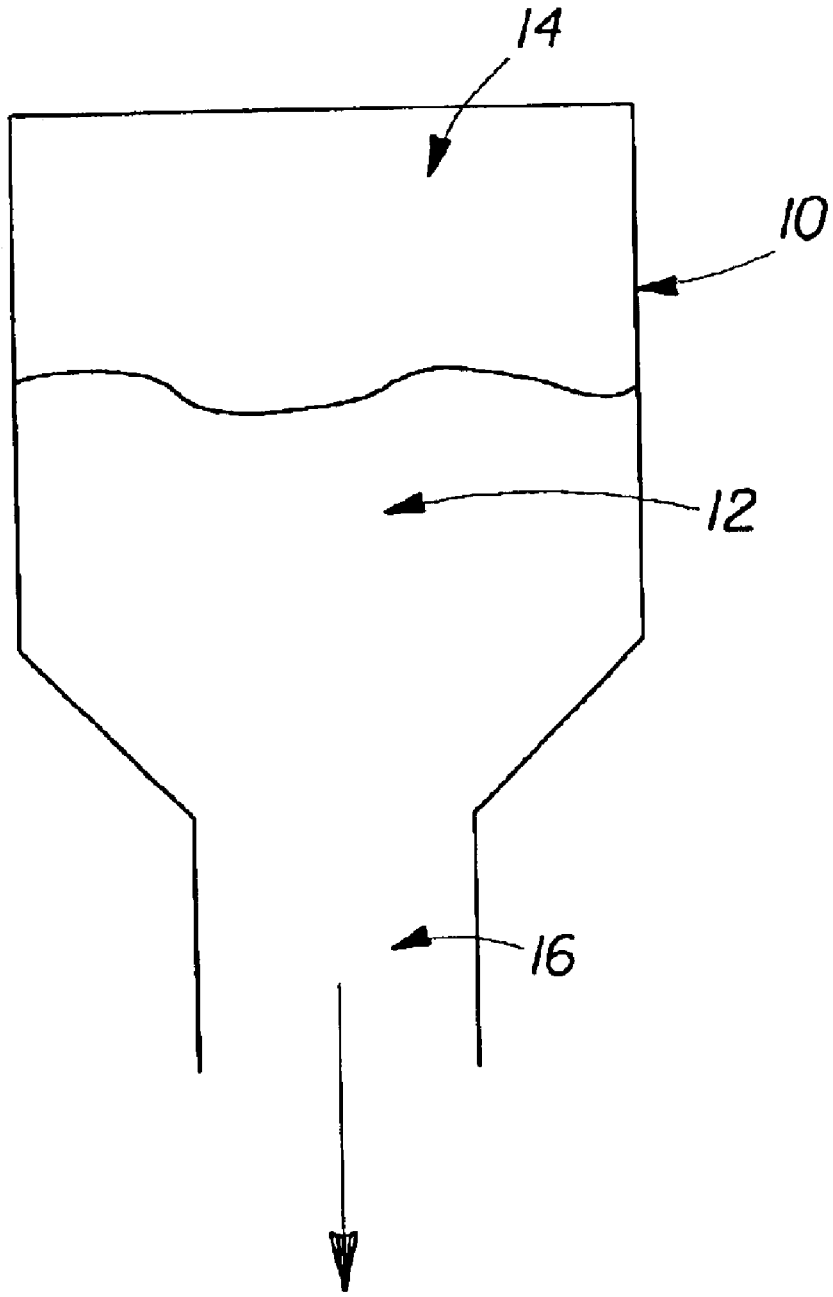
FIG. 1 is a schematic illustration of one embodiment of sequential dispensing of a consumable layered liquid composition according to the present invention.

As used herein, the term "consumable layered liquid composition" means a liquid composition that comprises two or more liquid layers; each layer comprises actives and is capable to be delivered sequentially to a surface in need of treatment at different times. In other words, the actives within each of the two or more layers do not need to be delivered all together. In order to be separately delivered, the consumable layered liquid composition useful in the present invention intentionally contains two or more separate, discrete liquid layers comprising actives that have different densities between one another, and are typically insoluble and/or immiscible in one another.

As used herein, the terms "actives" and "benefit agents" are interchangeable and refer to the liquid components that comprise the majority (i.e., at least about 50 wt %) of the liquid layers which deliver the desired fabric care benefits to the fabric article being treated. On the other hand, the term "additives" refers to the adjunct components incorporated into the liquid components to provide additional fabric care benefits. The additives may be a liquid or a solid.

As used herein, the term "fabric article" means any article that is customarily cleaned in a conventional laundry process or in a dry cleaning process. The term encompasses articles of clothing, linen and drapery, clothing accessories, and carpets. The term also encompasses other items made in whole or in part of fabric, such as tote bags, furniture covers, tarpaulins and the like. Furthermore, the fabric article may be made of natural and artificial materials, including, but not limited to, cotton, wool, silk, rayon and nylon.

As used herein, the term "refreshing" or "refreshment" refers to the composition or method that removes malodors, wrinkles, or other factors contributing to the stale, tarnished appearance from a fabric article and reestablishes its freshness aspect.

As used herein, the term "density differential" means the difference in densities between any two liquid layers.

All percentages, ratios and proportions used herein are by weight unless otherwise specified.

The Consumable Layered Liquid Composition

The consumable layered liquid composition comprises two or more liquid layers that exhibit a density differential between one another. In some embodiments, the liquid layers may each comprise one or more liquid components (also referred to herein as benefit agents or actives), which are selected based upon the desired use of the consumable layered liquid composition. Optionally, one or more of the liquid layers comprise an additive to provide additional benefit to the fabric article being treated.

In a typical embodiment of the present invention, the liquid composition comprises two liquid layers, wherein the first and second liquid layers are in direct contact with each other and have different densities. In one embodiment, the density differential is in the range from about 0.001 g/L to about 1 g/L. In another embodiment, the density differential is in the range from about 0.01 g/L to about 0.5 g/L. In yet another embodiment, the density differential is in the range from about 0.05 g/L to about 0.1 g/L. In a specific embodiment, the first liquid layer exhibits a density higher than the density of the second liquid layer. For example, the first liquid layer may exhibit a density of from about 0.7 to about 1.5 g/L and the second liquid layer may exhibit a density of from about 0.1 to about 1 g/L. The specific densities of the first and second liquid layers are not crucial, so long as there is a density differential between them.

The first liquid layer and the second liquid layer can be substantially incompatible or insoluble in each other. In one embodiment, the first liquid layer and the second liquid layer are less than 5 wt % soluble in each other, preferably less than 3 wt % soluble in each other, and more preferably less than 1 wt % soluble in each other. From a formulation perspective, the layered liquid compositions of the present invention provide the additional advantage of enabling the use of materials that are incompatible or insoluble or otherwise difficult to formulate into a stable, single phase composition.

The liquid layers are present in the liquid composition in sufficient quantity to deliver separate benefits. Further, they are present in sufficient quantity to form separate layers in order to facilitate sequential delivery of the benefits. It is also recognized that certain benefits can be achieved with a minimal quantity of materials. Thus, each liquid layer can be at least about 0.05 wt %, preferably at least about 0.08 wt %, more preferably at least about 0.1 wt % of the consumable layered liquid composition useful in the present invention. In a typical embodiment, the weight ratio of the first liquid layer to the second liquid layer ranges from about 0.0005:1 to about 1:1, preferably from about 0.005:1 to about 0.5:1.

The first liquid layer and the second liquid layer may, individually, be a phase separated liquid or a homogeneous liquid. For example, a phase separated liquid layer may comprise incompatible or insoluble liquid components, wherein the minor component forms discontinuous domains dispersed in the continuous major component. A phase separated liquid layer may, alternatively, comprise additives dispersed in discrete regions in a continuous matrix of the liquid component.

The benefit agents in the first and the second liquid layers may be the same or different types and may be incorporated in the same or different amounts. It is especially desirable to have a layered liquid composition wherein the first liquid layer comprises a first benefit agent and the second liquid layer comprises a second benefit agent to deliver different benefits at different times (e.g., in a sequential manner). The benefit agents may comprise any suitable fabric care agent known to those in the art. Nonlimiting examples of fabric care agents include: surfactants, enzymes, bleaches, perfumes, finishing agents, texturing agents, sizing agents, crispness agents, anti-wrinkle agents, anti-static agents, water repellent agents, and mixtures thereof. In one specific embodiment, the first benefit agent is a refreshing agent and the second benefit agent is a finishing agent.

In some embodiments, the composition useful in the present invention is flowable so that the composition can be dispensed via spraying, pumping, suction, or like methods known in the art. The flowable composition typically have a viscosity of less than about 10 mPa.sec, preferably less than about 5 mPa.sec and more preferably less than about 1 mPa.sec. Viscosity measurements can be determined with a Brookfield LVF viscometer, using spindle 4 at 60 rpm and room temperature.

It is recognized that shaking, rotating or like motions may disturb or mix the liquid layers temporarily. The composition useful in the present invention should spontaneously reform the layered structure when it is allowed to rest. The composition useful in the present invention typically restores its layered structure in less than about 60 minutes, preferably less than about 10 minutes, more preferably less than about 5 minutes.

A. Liquid Components of the Compositions

The composition useful in the present invention may comprise two or more liquid components (also referred to as the benefit agents or actives) selected from the group consisting of: water, surfactants, perfumes, bleaches, preservatives, auxiliary refreshing agents, finishing agents, wrinkle control agents, shrinkage reducing agents, organic solvents, and mixtures thereof. These liquid components comprise the majority of the liquid layers of the composition, typically greater than 50 wt %, preferably greater than 90 wt %, and more preferably greater than 95 wt % of each liquid layers. For example, the liquid layers may comprise water, glycol and/or an alkyl or alkoxy alcohol, a silicone, a perfume and mixtures thereof. The liquid components are selected such that they exhibit a density differential sufficient to allow them to form at least two discrete liquid layers.

(i) Water

Typical layered liquid compositions useful in the present invention can comprise at water as one of the liquid components. In some embodiments, water comprises at least about 80%, preferably at least about 90%, and more preferably at least about 95%, by weight of the composition.

(ii) Solvents

The compositions, optionally, can contain one or more solvents at effective levels for refreshing fabric articles. When present, the solvent typically comprise at least about 0.1%, preferably at least about 0.5% and more preferably at least about 3%, and no more than about 8.5%, preferably no more than about 7% and more preferably no more than about 5% by weight of the composition.

Suitable solvents may be selected from the group consisting of glycol ethers, including, but not limited to, mono-propylene glycol mono-propyl ether, di-propylene glycol mono-propyl ether, mono-propylene glycol mono-butyl ether, di-propylene glycol mono-propyl ether, di-propylene glycol mono-butyl ether, tri-propylene glycol mono-butyl ether, ethylene glycol mono-butyl ether, di-ethylene glycol mono-butyl ether, ethylene glycol mono-hexyl ether and di-ethylene glycol mono-hexyl ether; alkyl or alkoxy alcohols, including, but not limited to, methanol, ethanol, isopropanol, n-butanol, iso-butanol, pentanol, 2-methyl-1-butanol, 2-butanol, methoxymethanol, methoxyethanol, methoxy propanol, ethoxypropanol, propoxypropanol, ethoxybutanol, methoxy propoxy propanol, ethoxy propoxy propanol, propoxy propoxy propanol, butoxy propoxy propanol, butoxy propanol; and mixtures thereof. "Butyl" includes both normal butyl, isobutyl and tertiary butyl groups. In one embodiment, the solvents include ethanol, propanol, propoxypropanol, mono-propylene glycol and mono-propylene glycol mono-butyl ether. The latter two are available from Dow Chemicals (Midland, Mich.) under the tradenames Dowanol DPnP® and Dowanol DPnB®. Di-propylene glycol mono-t-butyl ether is commercially available from Arco Chemicals (Newtown Square, Pa.) under the trade name Arcosolv PTB®.

In some embodiments, desirable solvents may have a terminal $C_3$–$C_6$ hydrocarbon attached to the ethylene glycol or propylene glycol moieties to provide the appropriate degree of hydrophobicity and, preferably, surface activity. Examples of commercially available hydrophobic refreshing solvents based on ethylene glycol chemistry include mono-ethylene glycol n-hexyl ether (Hexyl Cellosolve® available from Union Carbide). Examples of commercially available hydrophobic refreshing solvents based on propylene glycol chemistry include the di-, and tri-propylene glycol derivatives of propyl and butyl alcohols, which are available from Arco Chemicals and Dow Chemicals under the trade names Arcosolv® and Dowanol®, respectively.

Further, in some embodiments, a mixture of solvents may provide a preservative effect in the consumable liquid compositions of the present invention. For example, a $C_1$–$C_6$ alkanol, such as isopropyl alcohol, combined with a glycol ether, such as propylene glycol n-propyl ether, can act as a preservative within the consumable liquid compositions of the present invention. When present, the alkanol and the glycol ether should typical have a weight ratio of from about 10:1 to about 1:10, preferably from about 5:1 to about 1:5, and more preferably from about 1:1 to about 2:1.

(iii) Perfumes

Perfumes and perfumery ingredients are also useful herein as the liquid components. A wide variety of natural and synthetic chemical ingredients are suitable for use herein, such as aldehydes, ketones, esters, and the like. Also suitable for use herein are various natural extracts and essences, which can comprise complex mixtures of ingredients, such as orange oil, lemon oil, rose extract, lavender, musk, patchouli, balsamic essence, sandalwood oil, pine oil, cedar, and the like. Finished perfumes can comprise extremely complex mixtures of these ingredients, wherein individual perfumery ingredients can comprise from about 0.0001% to about 90% of a finished perfume mixture.

When present, the perfume (including the finished perfume mixtures) may comprise from about 0.0001% to about 0.5%, more preferably from about 0.001% to about 0.4%, even more preferably from about 0.005% to about 0.3%, by weight of the composition.

(iv) Silicones

Refreshing agents such as silicones may also be included in the consumable liquid compositions useful in the present invention. Silicones capable of being vaporized are especially suitable for certain embodiments of the present invention. Some silicones may also provide multiple other benefits, such as color rejuvenation benefits, softness benefits and wrinkle control benefits. Other silicones may also provide anti-pilling benefits and/or water repellency benefits. The color rejuvenation benefits may be tailored to be durable for a certain period of time by blending certain silicones, especially polydimethylsiloxanes (PDMS), in varying amounts. Suitable PDMS are commercially available from Dow Corning, General Electric and other suppliers.

In a typical embodiment, the silicones comprise a distribution of short-chain PDMS molecules and mono-dimethylsiloxane molecules, wherein the number of dimethylsiloxane (DMS) units for the linear PDMS is at least about 3, preferably from about 3 to about 15, more preferably from about 3 to about 10, and even more preferably from about 5 to about 8 for the linear PDMS (i.e., L5–L8); and preferably from about 3 to about 15, more preferably from about 3 to about 9 for the cyclic PDMS (i.e., D3–D9). The terminal ends of the PDMS molecules can be trimethyl siloxanes. Suitable silicones as disclosed above typically have number-average molecular weights from about 100 to about 2000 g/mol, and preferably from about 150 to about 1000 g/mol.

In another embodiment, the silicone comprises a PDMS mixture having less than about 2% by weight of molecules having 1 or no DMS units and less than 2% by weight of molecules having 8 or more DMS units. In other words, a PDMS mixture comprising predominantly of molecules with 2 to 7 DMS units. The linear PDMS molecules are especially suitable alone or in a mixture with other linear siloxanes, whereas cyclic siloxanes are preferably be blended with linear PDMS molecules.

When present, silicone comprises from about 0.5% to about 10%, more preferably from about 1% to about 8%, even more preferably from about 2% to about 5%, by weight of the composition.

(v) Others

Suitable shrinkage reducing agents are selected from the group consisting of ethylene glycol, all isomers of propanediol, butanediol, pentanediol, hexanediol and mixtures thereof. More preferably, the shrinkage reducing agents are selected from the group consisting of neopentyl glycol, polyethylene glycol, 1,2-propanediol, 1,3-butanediol, 1-octanol and mixtures thereof. When present, the shrinkage reducing agents comprise up to about 2%, by weight of the composition.

The surfactant is preferably a nonionic surfactant, such as an ethoxylated alcohol or ethoxylated alkyl phenol, and is present at up to about 2%, by weight of the composition.

B. Additives in the Compositions

Compositions useful in the present invention may-contain additives, such as auxiliary refreshing agents, auxiliary finishing agents, texturing agents, crisping agents, antistatic agents, soil repellent agents, antimicrobial agents, color care agents, wrinkle control agents, preservatives, and mixtures thereof. These actives need not be liquid. However, they can be incorporated into the composition by dissolving, mixing, dispersing or suspending in at least one of the above liquid components comprising the majority of the liquid layers.

When present, the additives comprises from about 0.1 to about 20%, preferably from about 0.5 to about 10%, more preferably from about 1 to about 5% by weight of the liquid layer in which they reside. In one embodiment, the first additive comprises from about 0.1 to about 20% by weight of the first liquid layer and the second additive comprises from about 0.1 to about 10% by weight of the second liquid layer, wherein the first additive may provide a first benefit useful in the refreshing step and the second additive may provide a second, different benefit useful in the finishing step.

C. Exemplary Compositions

While the liquid compositions suitable for use herein can comprise water and perfume only, additional fabric care agents can also be included. In one embodiment, the composition suitable for use in the methods of the present invention comprises:

| Ingredient | Range (% wt.) |
|---|---|
| Solvent Dowanol DPnP ® | 0.5–0.9 |
| Isopropyl alcohol | 0.2–0.6 |
| Perfume | 0.1–0.5 |
| Preservative | 0–0.0003 |
| Sodium Benzoate | 0–0.1 |
| Water | Balance |

In another embodiment, the composition suitable for use in the methods of the present invention comprises:

| Ingredient | Range (% wt.) |
|---|---|
| Water | 95.1–99.9 |
| Perfume | 0.05–1.5 |
| Surfactant | 0.05–2.0 |
| Alcohol | Optional to 4% |
| Solvent | Optional to 4% |
| Hydrogen peroxide | Optional to 4% |
| pH in the range from about 6 to about 8 | |

In yet another embodiment, the composition suitable for use in the methods of the present invention comprises:

| Ingredient | Range (% wt.) |
|---|---|
| Linear PDMS | 3–6 |
| Phenoxyethanol | 0.8–1.5 |
| Perfume | 0.05–2.0 |
| Water | Balance |

Additional compositions useful in the methods of the present invention can be based on the references below. These compositions may be modified such that the total emulsifiers and/or surfactants content is from about 0% to less than about 5 wt % of the composition so that the liquid components separate and form at least two discrete liquid layers. A liquid composition comprising organic solvents, surfactants, perfumes, preservatives, bleaches and auxiliary cleaning agents can be found in U.S. Pat. No. 5,789,368, which issued on Aug. 4, 1998 to You et al. Other liquid compositions suitable for use herein are described in U.S. Pat. No. 5,912,408, issued on Jun. 15, 1999 to Trinh and Siklosi. Shrinkage reducing compositions suitable for use herein can be found in PCT Publication No. WO00/11133, published on Mar. 21, 2000 to Strang and Siklosi.

The Product

The present invention also encompasses a product comprising the consumable liquid layered composition described above and a container for the composition. The article of manufacture may further comprise a set of instructions, on the container or additional packaging associated therewith, to instruct the user to dispense the composition in a sequential manner, that is, a first benefit is delivered to the fabric article being treated before a second benefit is delivered to the fabric article, in a treatment cycle. More details of the sequential dispensing method are disclosed below.

The layered liquid composition useful in the present invention may be packaged in a single container, such as a bottle, a cartridge, and like containers. In some embodiments, the layered liquid composition is transferred from the single container to a dispensing means in the apparatus for unit-dose, sequential dispensing during a treatment cycle. In other embodiments, the layered liquid composition may be packaged for a unit-dose single application, such as a bag, a foil pack, or other single dose dispensers known in the art. As used herein, the term "unit-dose" means the amount of composition to provide the effective amount of vapor or fine mist sufficient to treat fabric articles inside a typical treating apparatus having an interior void space of about 10,000 to about 25,000 $cm^3$, which is sufficient to hold a load of from about 0.2–5 Kg of fabric articles. In some embodiments, a unit dose is about 25–500 milliliters, preferably about 50–250 milliliters, and more preferably about 100–150 milliliters, of the layered liquid composition. The unit does of the liquid layer composition may be adjusted in proportion to the interior void space of the apparatus. The container may be transparent or have a see-through window so that the liquid layers are visible to a consumer. The visual cue suggests to the consumer that the present composition is capable of delivering multiple benefits to fabric articles treated by the composition.

The Method of Sequential Dispensing of the Composition

The layered liquid composition is especially useful in dispensing the first and the second liquid layers in a sequential manner. As shown in FIG. 1, the container 10 holds a layered liquid composition having a first liquid layer 12 and a second liquid layer 14. During use, the first liquid layer 12 can be dispensed first through the opening 16 of the container 10, and after the first liquid layer 12 is consumed, the second liquid layer 14 would be dispensed through opening 16.

The opening 16 of the container 10 may be positioned to point upward or downward, depending on the densities of the first and the second liquid layers 12, 14 and the desired sequence for dispensing these liquid layers. For instance, by turning the container 10 upside down such that the opening 16 points downward, the higher density liquid layer can be dispensed and consumed first. Alternatively, by maintaining the container 10 in an upright position such that the opening 16 points upward, the lower density liquid layer can be dispensed and consumed first. Further, by carefully installing (to minimize the mixing of the liquid layers) a pumping means or a suction means, which reaches into the bottom of the container 10, the higher density liquid layer can be dispensed first in this upright position. The pumping or suction means may be operatively connected to a spraying means so that the composition may be delivered to the articles being treated in the form of fine fluid droplets.

In a specific embodiment, the first liquid layer 12 may comprise water, a glycol ether, an alkyl or alkoxy alcohol, or mixtures thereof, and the second liquid layer 14 may comprise a silicone, a perfume, or mixtures thereof; thus, the first liquid layer 12 has a higher density than the second liquid layer 14. It is desirable to deposit a silicone or perfume onto a fabric article during a "finishing step", which typically takes place after a "refreshing step" that delivers water and/or other additives to the fabric article for the removal of soils or stains. The embodiment illustrated in FIG. 1 is particularly suitable for the desired sequence of delivery of this exemplary layered composition to a fabric article.

In some embodiments, the consumable liquid composition useful in the present invention is flowable at room temperature so that the composition can be dispensed as is (i.e., without heating) by spraying, pumping, suction, or combinations thereof, using devices known in the art. In order to avoid spotty coverage of the fabric article being treated, it is preferred that suitable nozzles be used to convert the composition into a mist of fine liquid particles having an average particle size of less than about 200 $\mu$m, preferably less than about 120 $\mu$m and more preferably less than about 80 $\mu$m. In other embodiments, the composition may be vaporized using a heating element, such as a hot plate, a heating mantle, a boiler, or other heating means known in the art. In yet another embodiment, the composition may be nebulized into a fine mist using an atomizer, a nebulizer, or like devices known in the art. The fine mist thus produced comprises small droplets of liquid with as average diameter preferably within the range of about 1 to about 35 $\mu$m, more preferably of about 1 to about 20 $\mu$m. A fine mist of nebulized droplets differs from vapors in that the former contains droplets of liquid having particle size in the micron range, while the vapors are made of molecules of liquid. However, for the purpose of the present invention, the nebulized fine mist and the vapors are considered equally effective regarding their ability to penetrate into the fabrics. A suitable device for use herein is a nebulizer that has at least one ultrasonic sonotrode, or ultrasonic vibrating cell. Such nebulizer is commercially available from Sono Tek Corporation, Milton, N.Y., under the trade name Acu Mist®. Still other examples of such devices can be purchased from the Omron Health Care, GmbH, Germany; or Flaem Nuove, S.P.A, Italy.

Once the composition is dispensed out of the container, the compositions may come into contact a fabric article being treated, thereby delivering refreshing, finishing, texturing and/or other fabric care benefits to the fabric article.

The first liquid layer of the composition may be nebulized into a fine mist of droplets, which carry the additives contained within the first liquid layer. Subsequently, the second liquid layer may then be nebulized into a fine mist of droplets, which carry additives contained within the second liquid layer. If the vaporization method is used, each liquid layer and the additives therein should preferably have similar volatility or vapor pressure so that the vaporization step does not separate them to any appreciable extent.

To properly refresh a fabric article, one must address many aspects of the article's smell and appearance. Specifically, the fabric article should at least be substantially free of odor and wrinkles after a refreshing treatment. It is often preferred that the article be perfumed to give it a pleasant odor, and it should be free of localized stains. The methods of this invention require at least two steps designed toward deodorizing, dewrinkling and/or perfume deposition on a fabric article. Additionally, a manual spot removal process for removing localized stains can be used in conjunction with the sequential dispensing method disclosed above. The conditions for each of these methods are described in greater detail below.

To use the layered liquid composition more effectively, it is desirable that refreshing/finishing treatment be conducted in a substantially enclosed space, such as inside a bag, a cabinet or a housing (referred to collectively as "a housing"). As used herein, the term "substantially encloses" means that the housing completely surrounds the fabric articles, but that the housing can, and preferably will, include one or more vents. An exemplary treatment apparatus comprising such a substantially enclosed housing is disclosed below.

It is understood that the method steps, including the deodorization step, the dewrinkling step, and the perfume deposition step, can be carried out in any appropriate order. If a perfume deposition step is employed, it typically follows the deodorization step, so that the perfume is not stripped off of the fabric immediately after it is laid down.

Deodorization is distinguished from odor-masking, which involves applying a pleasant scent to a fabric to mask, or cover up the odors on the fabric. Deodorization, as used herein, involves the actual removal or neutralization of malodor causing chemicals. When the malodor-causing constituents are removed or neutralized, the fabric article should have little or no residual odor. This step of the present method can be carried out with ozone, which neutralizes odors; or with high temperatures and venting, which remove the odor-causing constituents from the treated fabric article and from the housing.

Thus, in a typical embodiment, deodorization is the first step. The deodorization step may be conducted under a first temperature of at least about 45° C., preferably at least about 60° C., and most preferably at least about 70° C. and a first relative humidity of at least about 20% (at said first temperature and 1 atm pressure). At these relatively high temperatures, odor causing chemicals are stripped off of fabrics, and then preferably removed from the housing via the vent. Even more preferably, the vent comprises a filter so that the odorous emanations do not enter the environment outside of the housing. A first process time starts when the first temperature and first relative humidity are reached; the first process time can be from about 2 minutes to about 20 minutes, preferably from about 5 minutes to about 15 minutes, and even more preferably from about 8 minutes to about 12 minutes.

The deodorization step described above can be supplemented, or even replaced, by treating the fabric articles with ozone. The use of ozone to neutralize odor-causing chemicals and to sanitize garments, for example, medical gowns, is well known to the art and disclosed in published patent applications DE 24 33 909 and FR 2059 841. For the methods disclosed herein, ozone can be introduced into the housing from any appropriate source, such as an ultraviolet lamp. One or more ozone sources can be used and they can be placed in any convenient location in or adjacent to the housing. The ozone source must be sized according to the volume of the housing and the surface area of the fabric articles being treated. The type and size of equipment to use for a given housing can be easily determined by those skilled in the art.

The second step of the present embodiment is directed to dewrinkling, which requires slightly higher temperature and relative humidity (referred to as the second temperature and second relative humidity, respectively). Further, good air circulation is beneficial to the dewrinkling step, but not necessary. For the second step, the second temperature should be greater than "T" as defined by the equation: $T=60-(0.17*RH_2)$, wherein $RH_2$ is the second relative humidity in percent. The second relative humidity is preferably at least about 85%, preferably at least about 90%, and more preferably at least about 95%. The second temperature is preferably less than about 90° C., more preferably less than about 80° C., and most preferably less than about 70° C. A second process time starts when the second temperature and second relative humidity are reached; the second process time can range from about 2 minutes to about 20 minutes, preferably from about 5 minutes to about 15 minutes, and even more preferably from about 8 minutes to about 12 minutes.

Finally, there is a third step involving a gradual cool down of the interior void space of the housing. Since the saturation humidity level decreases with decreasing temperature, vapors begin to condense as the temperature inside the housing decreases. Since the housing forms an enclosure around the fabric article, some of the vapors condensing inside the housing will naturally fall on the fabric articles; as these articles dry, the benefit agents, such as perfume, remain on the article. As discussed above, the method steps of this invention are designed to deliver benefit agents without undue waste and without saturating the fabrics to the point where they need additional drying. During the third step in the process the temperature within the interior void space of the housing decreases to a third temperature of less than about 45° C., preferably less than about 40° C., and more preferably less than about 35° C. A third process time starts when the cool down step starts; the third process time can be from about 2 minutes to about 20 minutes, preferably from about 3 minutes to about 10 minutes, and even more preferably from about 3 minutes to about 5 minutes.

A layered liquid composition is provided for the treatment of the fabric article inside the housing. The composition can be added to the housing directly, in a bottle, a cartridge, a bag, a foil pack, or any other container known to those skilled in the art. Preferably, the composition is in a cartridge that is introduced into the interior void space of the housing and the refreshing composition is released from the cartridge into the interior void space of the housing.

Apparatus

The methods of this invention can be conducted in any appropriate apparatus. Such apparatuses comprise a housing that substantially encloses the fabric articles being treated. The housing must have an opening providing access to the fabric articles, and preferably, there is a bar, a hook or other hanging means on which to hang the fabric articles. Suitable apparatuses are disclosed in WO 02/15663, by Duval et al., and WO 02/28764, by Verherbrugghen et al.

Cabinets, wardrobes, and garment bags are all appropriate for use as the housing in the present invention. However, it has been found that the vapors from the actives, and the accompanying additives, preferentially condense in the corners and along the sharp edges of a more conventional rectangular-shaped cabinet. Though the method of this invention can be conducted in a rectangular cabinet, it is more efficiently conducted inside a housing that preferably has rounded corners or an egg-shell shaped wall. The fewer sharp edges and corners the housing has, the more efficient it is. Tumble dryers commonly found in home appliances may be useful herein as the housings. However, these tumble dryers may not have temperature or humidity controllers, or means to provide the ability to program a multi-step process with respect to both temperature and humidity. Thus, with some additional programming means and controllers, a common tumble dryer can be adapted to function as the housing useful in the present invention.

In addition to the wall that defines an interior void space, the housing suitable for use in this invention may comprise: a vent; an active temperature controller capable of changing and maintaining the air temperature within the interior void space of the housing; a passive humidity controller capable of changing and maintaining the relative humidity of the air within the interior void space of the housing; a heating element, which is capable of heating liquid compositions to produce vapors and which can heat air to dry the treated article inside; and an air circulation device, for example, a fan. Even more preferably, the air circulation device is a fan and the fan inlet is within the interior void space of the housing so that at least a portion of the air within the void space of the housing is recirculated. Additionally, a filter may be provided in or adjacent to the housing.

The refreshing composition can be added to the housing in any appropriate way, including those containers described above. The composition can also be poured into the housing or be poured into a reservoir that feeds into the heating element/humidifier; canisters can be used to inject the composition; or an absorbent substrate saturated with the composition can be placed in the housing.

Pre-Treatment of Fabric Article

The refreshing treatment disclosed above may be combined with a pre-treatment step to remove soils and stains from the fabric article.

A. Spot Cleaning Composition

The user of the present process can be provided with various spot cleaning compositions to use in the optional pre-treatment step herein. These compositions are used to remove localized stains from the fabric articles being treated, either before or after the refreshing process disclosed above. The spot cleaning composition should be compatible with the fabric being treated. That is, no meaningful amount of dyes should be removed from the fabric article during the spot treatment and the spot cleaning composition should leave no visible stains on the fabric article. In order to provided spot cleaning compositions which are substantially free of materials that leave visible residues on the treated articles, the compositions are formulated to contain a high level of volatile materials, preferably water, which typically comprises about 95%, preferably about 97.7% by weight of the spot cleaning composition, and surfactant at levels of about 0.1% to about 0.7% by weight of the spot cleaning composition. A preferred spot cleaning composition will also contain a cleaning solvent such as butoxy propoxy propanol (BPP) at a low, but effective, level, typically about 1% to about 4%, preferably about 2% by weight of the spot cleaning composition. Spot cleaning methods and compositions are described in U.S. Pat. No. 5,789,368, to You et al. and U.S. Pat. No. 5,630,847, to Roetker.

B. Treatment Member

In one embodiment, a treatment member is provided to assist in removing localized stains from fabric articles. In one embodiment, the spot cleaning composition is provided in a dispenser, such as a bottle, and the dispenser has a distal tip that can serve as the treatment member. Additionally, the treatment member can comprise an absorbent substrate material which can be, for example, a natural or synthetic sponge, an absorbent cellulosic sheet or pad, or the like. Said substrate materials may have multiple protrusions extending outward from the substrate material to serve as the treatment members. Specific examples of treatment members can be found in U.S. Pat. No. 5,789,368, to You et al.

C. Absorbent Stain Receiving Article

An absorbent stain receiving article, sometimes referred to herein as a stain receiver, may also be used in the optional pre-treatment step herein. Such stain receivers can be any absorbent material which imbibes the spot cleaning compositions used in the pre-treatment step. Disposable paper towels, cloth towels such as BOUNTY™ brand towels, clean rags, etc., can be used. In some embodiments, the stain receiver is designed specifically to "wick" or "draw" the liquid compositions away from the stained area. One type of stain receiver consists of a nonwoven pad, such as a thermally bonded air laid fabric ("TBAL"). Another type of stain receiver for use herein comprises polymeric foams made from a polymerized water-in-oil emulsion, sometimes referred to as "poly-HIPE". The manufacture of polymeric HIPE foams is very extensively described in U.S. Pat. No. 5,260,345 to DesMarais, et al., issued Nov. 9, 1993; U.S. Pat. No. 5,550,167 to DesMarais, issued Aug. 27, 1996, and U.S. Pat. No. 5,650,222 to DesMarais et al., issued Jul. 22, 1997. Additional disclosure of conditions for forming the polymeric foams are described in U.S. Pat. No. 6,013,589, to DesMarais, et al., issued Jan. 11, 2000; and PCT Publication No. WO 99/46319, published Sep. 16, 1999, by DesMarais, et al.

Various stain receivers may preferably comprise a liquid impermeable backsheet. The backsheet can be made of a thin layer of a liquid impermeable material, such as polypropylene, polyethylene and the like. The backsheet provides protection for the surface that the stain receiver rests on from the spot cleaning composition. For example, spot cleaning processes are typically performed on a hard surface, such as a table top. The stain receiver is placed on the table and the fabric article to be treated is placed on the stain receiver. Spot cleaning composition is applied to the stained area of the article, then is drawn into the stain receiver. But in the absence of a backsheet, the spot cleaning composition can leak onto the table top, possibly damage it.

EXAMPLES

The following Examples further illustrate the invention, but are not intended to be limiting thereof.

Example I

Two extra-large men's jackets that have been exposed to cigarette smoke and wrinkled using standardized methods, are placed on clothes hangers. These jackets are then hung on the inside of a plastic housing that has two parallel flat ends (the top and bottom) with the sidewalls being substantially rounded or slightly outwardly bowed near the center. That is, the housing can be thought of as shaped like an egg shell with the top and bottom flattened. The housing has a door for accessing the interior, and the door is closed with a zipper. A small slit near the bottom of the housing serves as the vent and the vent remains open at all times during this process.

Inside the housing, there are a fan, a heating element, a thermocouple and a reservoir that can come into contact with the heating element when needed. Approximately 100 to 125 milliliters of a layered liquid composition of the present invention is poured into the reservoir and the door is closed.

An exterior "on/off" switch is turned on to begin the treatment process. The switch is connected to a programmable microprocessor that controls the multi-step process. First, the temperature inside the housing is raised to about 70° C. with a relative humidity of about 50%. This is accomplished by adjusting the vent, running the fan and placing the heating element near or in contact with the first layer of the layered liquid composition. The heating element and the fan function cooperatively to evaporate the first layer and distribute the vapors to the interior of the housing. This first step lasts for about 10 to 15 minutes, or until the first layer of the composition is consumed.

For the second step, the temperature inside the housing is reduced to about 50° C. and the relative humidity is raised to greater than about 95% by adjusting the vent, the fan and the heating element. Again, the heating element and the fan function cooperatively to evaporate second liquid layer of the composition and distribute the vapors to the interior of the housing. The fan continues to run during this second step, which lasts for about 7 to 9 minutes, or until the second layer of the composition is consumed.

Finally, with the heating element is turned off and the temperature inside the housing is allowed to cool naturally to about 45° C. in less than about 10 minutes. The fan is turned off automatically at the end of this step, and an indicator light signals that the process is complete. The jackets are removed from the housing and they are in a substantially wrinkle free, deodorized and ready to wear condition.

Example II

Two extra-large men's jackets that have been exposed to cigarette smoke and wrinkled using standardized methods, are placed on clothes hangers. These jackets are then hung on the inside of a plastic housing that has two parallel flat ends (the top and bottom) with the sidewalls being substantially rounded or slightly outwardly bowed near the center. That is, the housing can be thought of as shaped like an egg shell with the top and bottom flattened. The housing has a door for accessing the interior, and the door is closed with a zipper. A small slit near the bottom of the housing serves as the vent and the vent remains open at all times during this process.

Inside the housing, there are a fan, an ultraviolet lamp, a heating element, a thermocouple and a receptacle for receiving a cartridge that contains a layered liquid composition. The receptacle can come into contact with the heating element when needed. Approximately 100 to 125 milliliters of a layered liquid composition of the present invention is contained in a unit dose container (e.g., a cartridge). After the cartridge is connected to the receptacle, the door is closed.

An exterior "on/off" switch is turned on to begin the fabric refreshment process. The switch is connected to a programmable microprocessor that controls the multi-step process. First, the ultraviolet lamp is turned on to produce ozone. The lamp remains lit for approximately 10 minutes. The vent is preferably closed and the fan is optionally running during this first step.

Second, the temperature inside the housing is raised to about 70° C. with a relative humidity of about 50%. This is accomplished by adjusting the vent, running the fan and placing the heating element near or in contact with the first layer of the layered liquid composition. The heating element and the fan function cooperatively to evaporate the first layer and distribute the vapors to the interior of the housing. The second step lasts for about 10 to 15 minutes, or until the first layer of the composition is consumed. Optionally, since the jackets may be substantially deodorized during the ozone treatment, this second step can be shortened by using a layered liquid composition containing a small amount of the first liquid layer, which may provide additional deodorizing benefit or other optional benefits.

In the third step, the temperature inside the housing is reduced to about 50° C. and the relative humidity is raised to greater than about 95% by adjusting the vent, the fan and the heating element. Again, the heating element and the fan function cooperatively to evaporate second liquid layer of the composition and distribute the vapors to the interior of the housing. The fan continues to run during this step, which lasts for about 7 to 9 minutes, or until the second layer of the composition is consumed.

Finally, with the fan running, the heating element is turned off and the temperature inside the housing is allowed to cool naturally to about 45° C. in less than about 10 minutes. The fan is turned off automatically at the end of this step, and an indicator light signals that the process is complete. The jackets are removed from the housing and they are in a substantially wrinkle free, deodorized and ready to wear condition.

All documents cited are, in relevant part, incorporated herein by reference; the citation of any document is not to be construed as an admission that it is prior art with respect to the present invention.

While particular embodiments of the present invention have been illustrated and described, it would be apparent to those skilled in the art that various other changes and modifications can be made without departing from the spirit and scope of the invention. It is therefore intended to cover in the appended claims all such changes and modifications that are within the scope of this invention.

What is claimed is:

1. A method for sequentially delivering fabric care benefits to a fabric article, the method comprising the steps of:

a. providing a consumable layered liquid composition, wherein the composition comprises a first liquid layer and a second liquid layer in a container, the first liquid layer and the second liquid layer are discrete layers in direct contact with each other, and optionally, at least one additive in the first or the second liquid layer;

b. dispensing the first liquid layer and contacting the fabric article with the dispensed first liquid layer, thereby delivering a first benefit to the fabric article; and c. dispensing the second liquid layer and contacting the fabric article with the dispensed second liquid layer, thereby delivering a second benefit to the fabric article.

2. The method according to claim 1 wherein the dispensed first liquid layer and the dispensed second liquid layer are in the form of a vapor or a fine mist.

3. The method according to claim 1 wherein the first liquid layer and the second liquid layer have a density differential ranging from about 0.001 g/L to about 1 g/L.

4. The method according to claim 1 wherein the first liquid layer and the second liquid layer are substantially insoluble in each other.

5. The method according to claim 1 wherein each liquid layer comprises at least about 0.01 wt % of the composition.

6. The method according to claim 1 wherein the first liquid layer comprises water.

7. The method according to claim 6 wherein the first liquid layer further comprises a liquid component selected from the group consisting of a glycol ether, an alkyl or alkoxy alcohol, and mixtures thereof.

8. The method according to claim 1 wherein the second liquid layer comprises a liquid component selected from the group consisting of a silicone, a perfume, and mixtures thereof.

9. The method according to claim 1 wherein the first liquid layer comprises a first additive, which is from about 0.1% to about 20% by weight of the first liquid layer, and the second liquid layer comprises a second additive, which is from about 0.1% to about 10% by weight of the second liquid layer.

10. The method according to claim 1 wherein the first liquid layer comprises a refreshing agent and the second liquid layer comprises a finishing agent.

11. The method according to claim 1 wherein the first or the second liquid layer is, individually, a phase separated liquid or a homogeneous liquid.

12. The method according to claim 1 wherein the first liquid layer comprises water and a liquid component selected from the group consisting of a glycol ether, an alkyl or alkoxy alcohol, and mixtures thereof; and the second liquid layer comprises a liquid component selected from the group consisting of a silicone, a perfume, and mixtures thereof.

13. The method according to claim 1 wherein the composition comprises two or more liquid components selected from the group consisting of: water, surfactants, perfumes, bleaches, preservatives, auxiliary cleaning agents, finishing agents, wrinkle control agents, shrinkage reducing agents, organic solvents, alkyl or alkoxy alcohols, glycol ethers, silicones, and mixtures thereof.

14. The method according to claim 1 wherein the composition comprises water or a volatile silicone.

15. The method according to claim 1 further comprising the step of providing a substantially enclosed housing and placing the composition and the fabric article inside the housing prior to step (b).

16. The method according to claim 1 wherein the container contains at least a unit-dose of the composition.

17. A fabric care product comprising:

a. at least a unit dose of a consumable layered liquid composition comprising:

a first liquid layer capable of delivering a first benefit, and a second liquid layer capable of delivering a second benefit, the first liquid layer and the second liquid layer are discrete layers in direct contact with each other; and b. a container for the composition.

18. The product according to claim 17 wherein composition comprises two or more liquid components selected from the group consisting of: water, surfactants, perfumes, bleaches, preservatives, auxiliary cleaning agents, finishing agents, wrinkle control agents, shrinkage reducing agents, organic solvents, alkyl or alkoxy alcohols, glycol ethers, silicones, and mixtures thereof.

19. The product according to claim 17 further comprising instructions, on the container or packaging associated therewith, for dispensing the composition in a sequential manner wherein the delivery of a first benefit is followed by the delivery of a second benefit, in a treatment cycle.

20. The product according to claim 17 wherein the container provides a view of the composition to a user of the product.

* * * * *